US011692364B2

(12) United States Patent
Corette, Jr.

(10) Patent No.: US 11,692,364 B2
(45) Date of Patent: Jul. 4, 2023

(54) PRY BAR

(71) Applicant: B-Cor Innovative Solutions LLC, Missoula, MT (US)

(72) Inventor: William Pauly Corette, Jr., Missoula, MT (US)

(73) Assignee: B-Cor Innovative Solutions LLC, Missoula, MT (US)

( * ) Notice: Subject to any disclaimer, the term of this patent is extended or adjusted under 35 U.S.C. 154(b) by 217 days.

(21) Appl. No.: 17/181,425

(22) Filed: Feb. 22, 2021

(65) Prior Publication Data

US 2021/0172185 A1 Jun. 10, 2021

Related U.S. Application Data

(63) Continuation-in-part of application No. 15/616,786, filed on Jun. 7, 2017, now Pat. No. 10,926,985.

(51) Int. Cl.
*B66F 15/00* (2006.01)
*E04G 23/08* (2006.01)

(52) U.S. Cl.
CPC ..... *E04G 23/08* (2013.01); *B66F 15/00* (2013.01); *E04G 2023/085* (2013.01)

(58) Field of Classification Search
CPC ..... B25B 27/00; B25B 27/306; B25C 11/00; B66F 15/00
See application file for complete search history.

(56) References Cited

U.S. PATENT DOCUMENTS

| | | | | |
|---|---|---|---|---|
| 28,645 | A | 6/1860 | Beard | |
| 546,521 | A | 9/1895 | Gatti | |
| 900,338 | A | 10/1908 | Wolfe | |
| 1,515,009 | A | 11/1924 | Bump | |
| 1,570,192 | A | 1/1926 | Younick | |
| D122,435 | S | 9/1940 | Huxel | |
| 2,272,362 | A | 2/1942 | Barker | |
| 4,042,210 | A | 8/1977 | Feldmann | |
| 4,768,271 | A | 9/1988 | Jacob | |
| D348,595 | S | 7/1994 | Kusner | |
| 6,125,720 | A | 10/2000 | Gohman | |
| 6,752,380 | B1 | 6/2004 | Taylor et al. | |
| 7,673,848 | B1 | 3/2010 | Provines | |
| 7,690,627 | B2 | 4/2010 | Harpell | |
| 8,628,063 | B1 | 1/2014 | Stone | |
| 8,658,063 | B2 * | 2/2014 | Park | C01G 51/006 252/519.15 |
| 8,955,827 | B2 * | 2/2015 | Brown | B25C 11/00 254/21 |
| D737,650 | S * | 9/2015 | Allen | B66F 15/00 D8/105 |
| D752,935 | S * | 4/2016 | Knox | D8/48 |
| 10,926,985 | B2 * | 2/2021 | Corette, Jr. | B66F 15/00 |
| 2005/0012257 | A1 | 1/2005 | Vigil | |
| 2005/0173685 | A1 * | 8/2005 | Skach | B25C 11/00 254/25 |
| 2007/0252117 | A1 * | 11/2007 | Harpell | B25C 11/00 254/1 |

(Continued)

*Primary Examiner* — Seahee Hong
(74) *Attorney, Agent, or Firm* — Fulwider Patton LLP

(57) ABSTRACT

A shaft, a wedge and a fulcrum plate connecting the shaft and wedge and having a transverse cross-section in one plane narrower than the shaft and a cross-section in an orthogonal plane wider than the transverse cross-section.

10 Claims, 8 Drawing Sheets

(56) References Cited

U.S. PATENT DOCUMENTS

| | | | | |
|---|---|---|---|---|
| 2009/0230369 | A1* | 9/2009 | Kurtz | B66F 15/00<br>254/131 |
| 2010/0115705 | A1* | 5/2010 | Allen | B25F 1/00<br>254/131.5 |

* cited by examiner

PRY BAR

CROSS-REFERENCES TO RELATED APPLICATIONS

This application is a CIP of U.S. patent application Ser. No. 15/616,786, filed Jun. 7, 2017.

FIELD OF THE INVENTION

The present invention relates to a pry bar or wrecking bar for lifting planks and withdrawing fasteners from wooden beams and the like.

BACKGROUND

Pry bars are well known in the construction and demolition industry for prying boards loose and removing fasteners. While numerous different constructions and styles of pry bars have been proposed for various applications, one application that has been severely neglected is deck boards which may have been anchored by robust fasteners to underlying support beams and have been in place for many years or decades resulting in corrosion of the fasteners and presenting great resistance to separation of the deck boards from the support beams. Thus, a need exists for a sturdy pry bar which can be used to conveniently access the interface between the deck boards and support beams to pry about a fulcrum to lift the deck board away from the support structure. The tool should be efficiently constructed to carry high bending movements in the area of the claw or wedge for the accessing under the deck board. It is this need to which a present invention is directed.

Pry bars and wrecking bars have long been known for their beneficial leverage in prying fastened work pieces apart and removing residual fasteners. It has been common practice to provide such wrecking bars with an elongated shaft curved at one end to form a U-shaped element, typically tapered to a transverse edge at the terminal extremity and often formed with a V-shaped open end notch for accessing fasteners to be withdrawn from a workpiece. The configuration of these wrecking bars is such that a clearance space was required over the workpiece for maneuvering of the shaft and handle to wedge the sharp edge of the working element into the space between workpieces and support beam to pry the pieces apart by leveraging forces against the underlying beam.

It has been proposed to form the working end of a pry bar with such a modified U-shaped element which opens laterally rather than being a fully reversed U-shape. Devices of this type are shown U.S. Pat. No. 5,957,429. In use such devices require the handle or shaft to be oriented in a vertical orientation during the prying loose of a workpiece limiting the reach to which the device might provide for access to workpieces and limiting the functionality thereof.

It has also been proposed to provide a pry bar of this type which includes a D-shaped hook opening to one side in such a manner that, during the working task, the handle is also typically oriented in a vertical orientation above the workpiece. A device of this type is shown U.S. Pat. No. 6,752,380.

Various pry bars and crowbars have been proposed as being constructed with an elongated shaft tapering at the distal end to a flat or somewhat rounded working end so that access to the working piece might be had from a lateral direction. Devices of this type are shown in U.S. Pat. No. 1,570,192 to Younick and U.S. Pat. No. 2,272,362 to Barker.

It has also been proposed to provide a prying tool including a shaft with a stop at one end and a curved point at the opposite end constructed with a convex surface formed with perforations purportedly to provide frictional resistance to entry too far into a lumber stack when a stevedore is unloading lumber from a cargo vessel or the like. A device of this type is shown U.S. Pat. No. 5,465,212 to Gatti. Such devices, while having functionality for stevedoring use, do not provide for convenient insertion of the working tip into the crevice between, for instance, deck boards and the underlying beams for convenient penetration to enable prying of the lever arm to lift the deck board itself.

SUMMARY OF THE INVENTION

The present invention includes an elongated shaft having a handle at one end and narrowed laterally at the distal extremity but expanded vertically to form an elongated fulcrum plate having a lower edge configured with a linear skid edge and projecting rearwardly to curve upwardly to form a rolling fulcrum point. A working tool projects from the fulcrum plate and may be formed with a laterally projecting edge to the wedge for accessing the crevice between a deck board and an underlying support beam, or may be formed with a V-notch to engage under the heads of fasteners to be pried loose.

The features and advantages of the invention will be more readily understood from the following detailed description which should be read in conjunction with the accompanying drawings.

DETAILED DESCRIPTION OF THE PREFERRED EMBODIMENTS

The pry bar of the present invention includes, generally, a shaft 21 (FIG. 1) formed at one end with a handle 23 and narrowed laterally in one plane at the opposite extremity to form an elongated fulcrum plate 25 mounting a tool in the form of a wedge or claw 27 at the distal end thereof.

Pry bars are well known in the construction and demolition industry for prying boards loose and removing fasteners. While numerous different constructions and styles of pry bars have been proposed for various applications, one application that has been severely neglected is deck boards which may have been fastened by fasteners to underlying support beams and have been in place for many years or decades resulting in corrosion of the fasteners to present great resistance to separation of the deck boards from the support beams. Thus, a need exists for a sturdy pry bar which both access the near side of deck boards to pry about a fulcrum to lift the deck boards and which is efficiently constructed to carry high bending movements in the area of the tool for the accessing under the deck board. It is this need to which a present invention is directed.

Figure 1:
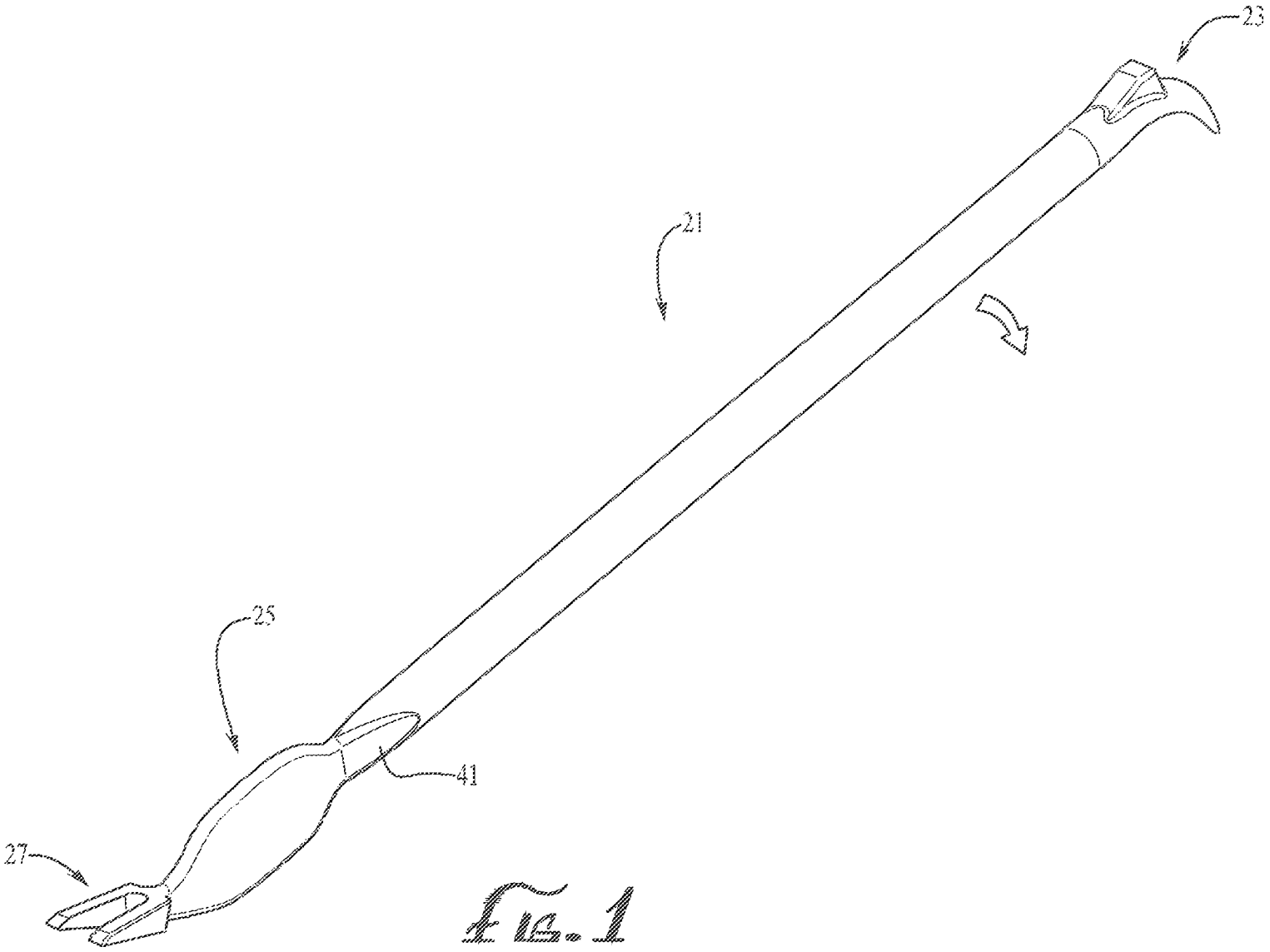
FIG. 1 is a perspective view of a pry bar embodying the present invention.
Figure 2:
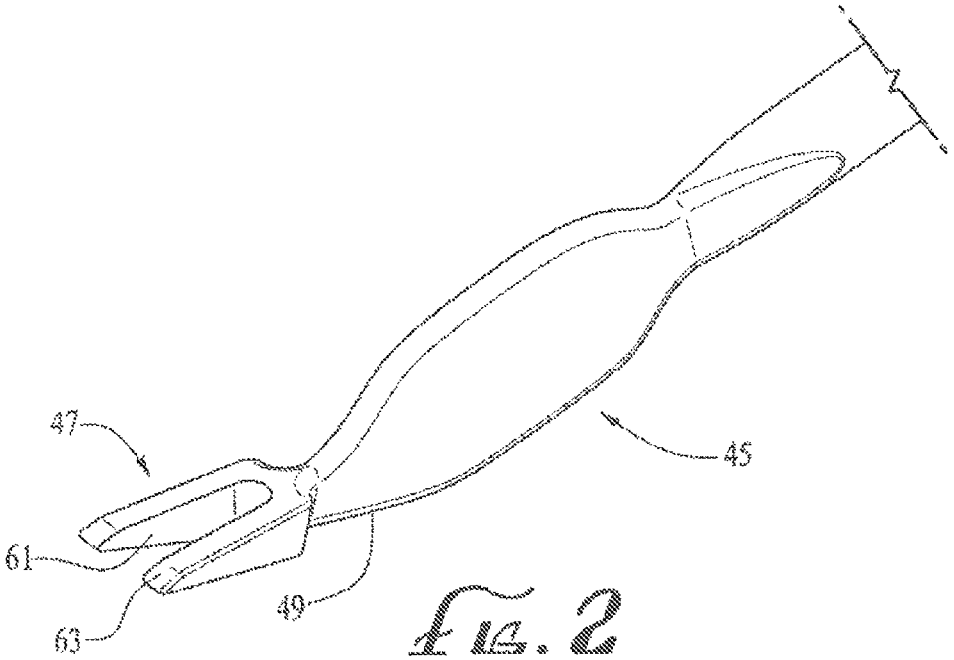
FIG. 2 is a detailed view, in a large scale, of the left hand extremity of the pry bar shown in FIG. 1.

For the purpose of this description, I refer to the orientation of my pry bar as shown in FIG. 1 with reference to the vertical as the working plane through which the bar typically rotates.

The pry bar of the present invention may be constructed of forged steel or other material having construction for resisting bending and the like upon applications of high bending forces.

The elongated shaft 21 is typically formed with a symmetrical transverse cross section such as round, hexagonal or the like. In practice, the shaft and overall length of the device may vary and so may come in different lengths so that access can be had to the workpiece without excessive stooping by the workman. The overall lengths which I have found desirable include but are not limited to 12, 24, 30, 42, 48 and 52 inches, though others will work.

Figure 5:
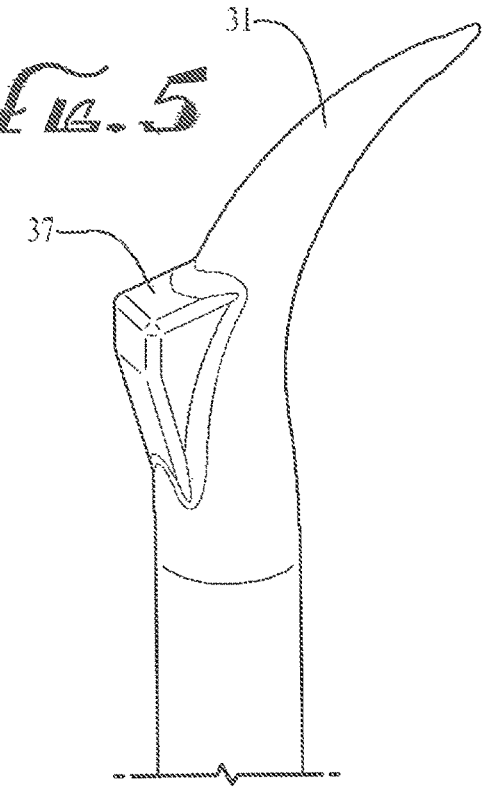
FIG. 5 is a detailed side view, in enlarged scale, of a handle incorporated in the pry bar shown in FIG. 1.
Figure 6:
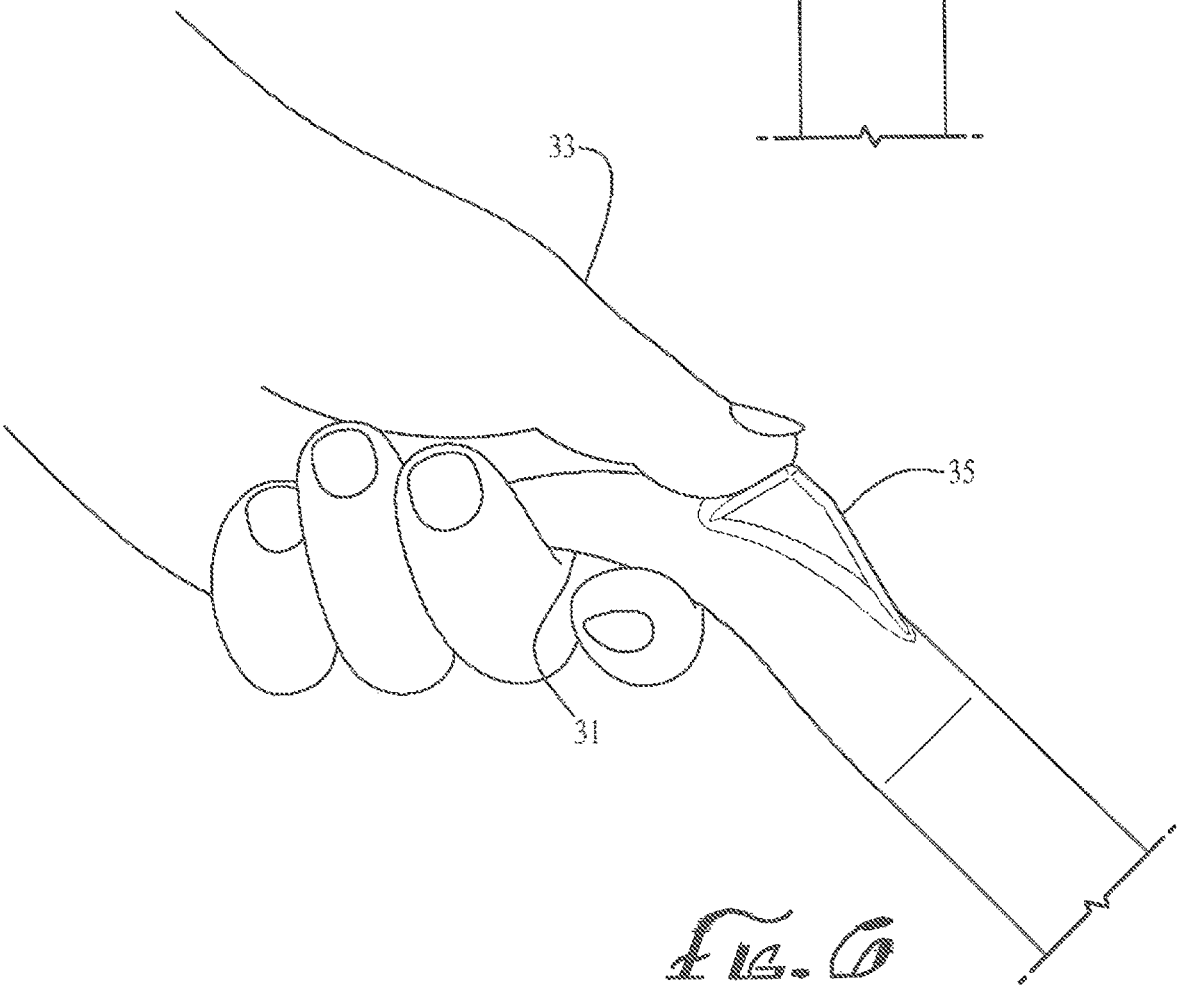
FIG. 6 is a view similar to FIG. 1 but showing the handle being gripped.

In one preferred embodiment, the handle 23 is curved gently downwardly to form a curved gripping section 31 (FIGS. 5 and 6) to be gripped by the workman's hand 33. The handle can be conveniently formed with a laterally projecting thumb press 35 having a proximally facing thumb surface 37.

The shaft 21 typically works though a working plane and tapers distally inwardly from the opposite sides at the distal end to form oppositely facing slanting facets 41 (FIG. 1) and then is configured with the wedges narrowed in the orthogonal direction and elongated, vertically to form the expanded oblong oval fulcrum plate 25. The fulcrum plate 25 is also formed with planer opposite sides and with a downwardly facing edge projecting proximally, configured with a tapered tool shown as a claw 47 to form a linear skid surface 49 and then curving proximally to form a curve defining a rolling fulcrum surface 51 and then formed with a reduced-in-radius of curvature to define a fulcrum edge surface 53 configured to ride on an underlying support surface. The fulcrum plate 25 is expanded vertically about a central axis 60 (FIG. 3) to form above the axis a laterally expanded beam section 63 to cooperate in resisting bending moments applied to such fulcrum plate. In this preferred embodiment, the claw device 47 forms a combination fastener-puller 61 shaped as a blade and then having a pair of fork tines defining tapered tips 64 tapered to narrow distally in the vertical plane.

In practice, I have constructed the shaft 21 with a diameter of about ⅝ of an inch but, for different applications, ⅜ of an inch to ¾ of an inch works well.

Figure 4:
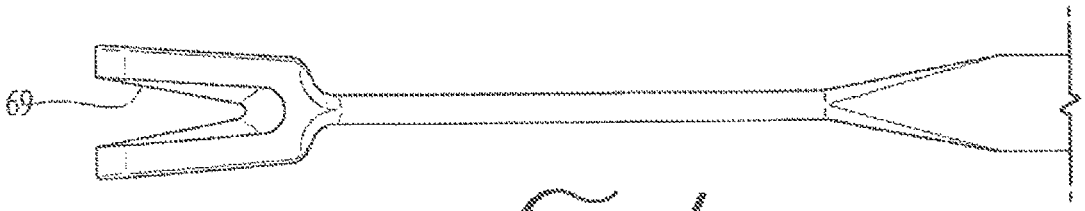
FIG. 4 is a top view of the fulcrum plate shown in FIG. 3.

The opposite edges of the shaft are then tapered along the facets 41 (FIG. 1) down from the ⅝ inch diameter to a width of about ⅜ of an inch for the fulcrum plate 25, though a thickness of ¼ to about ⅜ of an inch is acceptable. As understood by those of skill the term "plate" refers to a geometric configuration whose thickness is small compared to the length and width. The plate has a longitudinal, horizontal major axis 60 and a vertical minor access dictated by the orientation of the pry bar when in its working plane for lifting planks on a horizontal deck. In one preferred embodiment, the plate has a major axis 60 of 3 inches in overall length. The gently curved edge 53 of the fulcrum section is about 2½ inches long and the length of the laterally inward taper 52 at the opposite ends curving laterally and distally inward over respective lengths of about ½ inch. In this configuration, the wedge defining the fork 47 is approximately ⅝ inch long and is conveniently configured with the central V-shaped notch 69 (FIG. 4) for engaging under the heads of fasteners for removal.

Figure 7A:
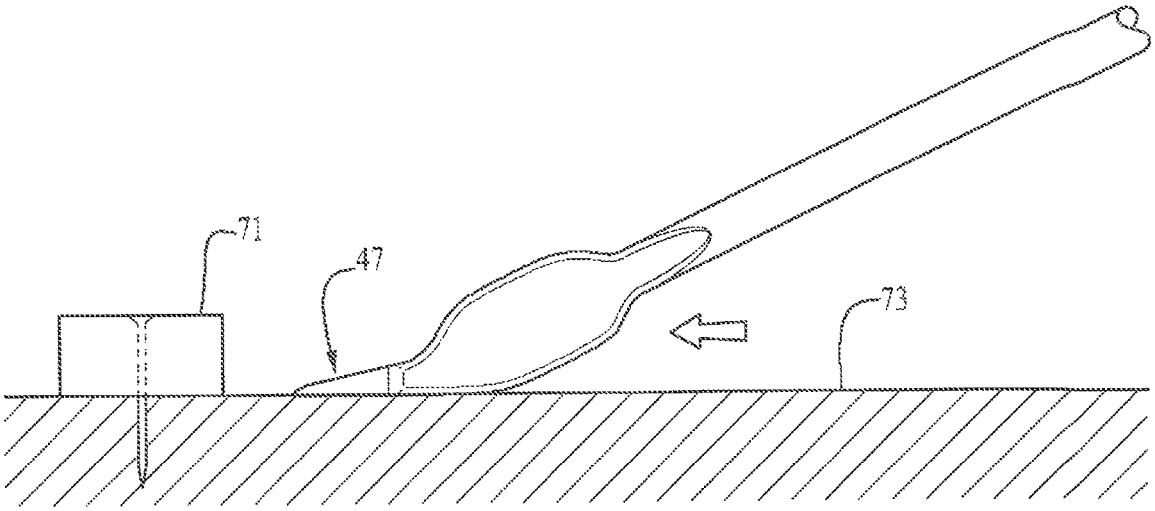
FIGS. 7A, 7B, 7C and FIG. 8 are side views of the distal extremity, in reduced scale, of the pry bar shown in FIG. 1, and depicted accessing the crevice between a deck board and the underlying beam.
Figure 7B:
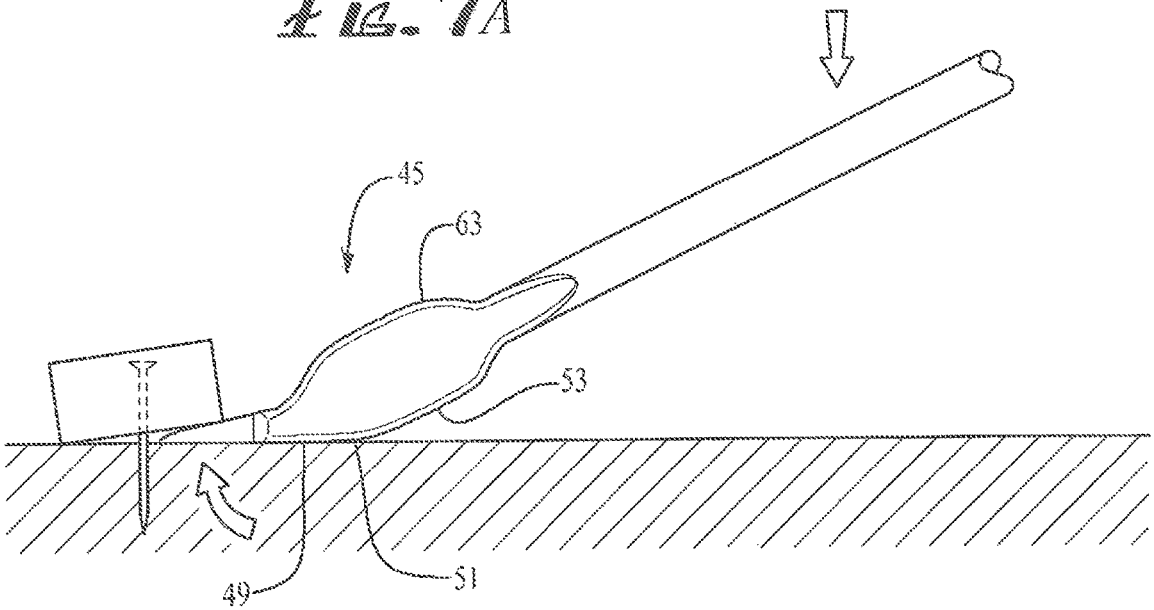
Figure 7C:
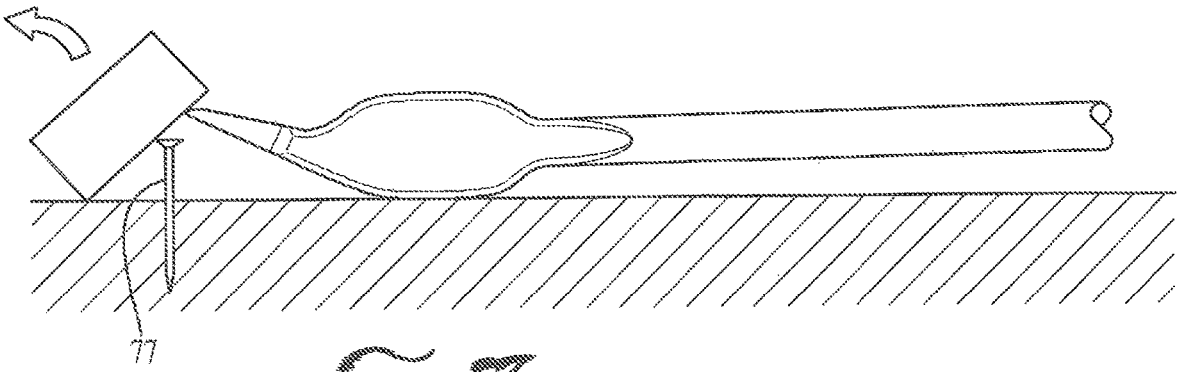

In operation, the pry bar of the present invention may conveniently be utilized to pry deck board 71 away from underlying support beam 73 (FIGS. 7A-7C). The blade 47 may penetrate under the deck board 71 as shown in FIG. 7B to wedge the one side of the board upwardly away from the support beam 73 and enable the wider base portion of such blade to be wedged under such pry board by wiggling the shaft upwardly and downwardly within the vertical pry plane as the blade 47 is slid distally as dictated by the skid edge 49 sliding along the surfaces of the beam 73 to the point shown in FIG. 7B, when the handle 31 may be pressed downwardly further to pry the fulcrum plate 45 about the rolling fulcrum curved surface 51 to the fully lowered position shown in FIG. 7C, thus raising the tip of the wedge to its extended vertical position, thereby tipping the plank free of the support beam.

Figure 8:
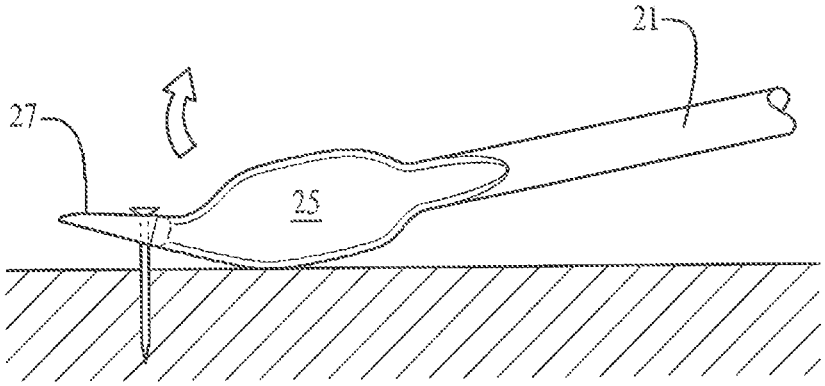

It will be realized by those skilled in the art that from time to time when fasteners 77 are corroded in place, such fasteners will fail to be drawn free with the freeing of the deck board 71, thus leaving them embedded in the support beam. The claw 27 incorporated in the wedge 47 may thus be re-engaged under the head of the fastener 77 to receive the shaft of such fastener within the notch 69 and the handle 31 again lowered to rotate the fulcrum plate 45 about such rolling fulcrum surface 51 as shown in FIG. 8 to withdraw the fastener from the support beam.

As will be appreciated by those skilled in the art, the long lever arm provided by the shaft 21 will be effective to, when the handle 31 is pressed downwardly, apply substantial leverage about the rolling fulcrum surface 51 to apply a high magnitude lifting force under the board 71 or under the head of the fastener 77. These forces are then resisted by the vertical cross section of the fulcrum plate to prevent undue bending or failure of such plate.

As will be appreciated by those skilled in the art, the resistance to bending in a beam is proportional to the lateral distance from the neutral axis in the plane in which the torque is applied. Thus, the vertical width of the fulcrum plate is important to the capability of the plate to resist bending as torque is applied due to prying of the shaft as the workman presses down on the handle to rotate about the rolling fulcrum point.

In this regard, it would be appreciated that, when the bar is in the working plane, the height of the plate 45 provides for a substantial body above and below the major axis at 60 so that there is substantial cooperation by the upper and lower halves of such plate as tension and compression forces respectively, are applied thereto during the leveraging work. As will be appreciated, the height of the plate disposes the working part of the beam spaced from the neutral axis to thereby provide substantial resistance to bending to provide a high moment of resistance. Further, by the fulcrum plate having a horizontal cross section narrower than the cross section of the shaft, the workman's view while manipulating the tool from the handle 31 is maximized, thereby providing a clear line of sight to the blade and fork.

Figure 9:
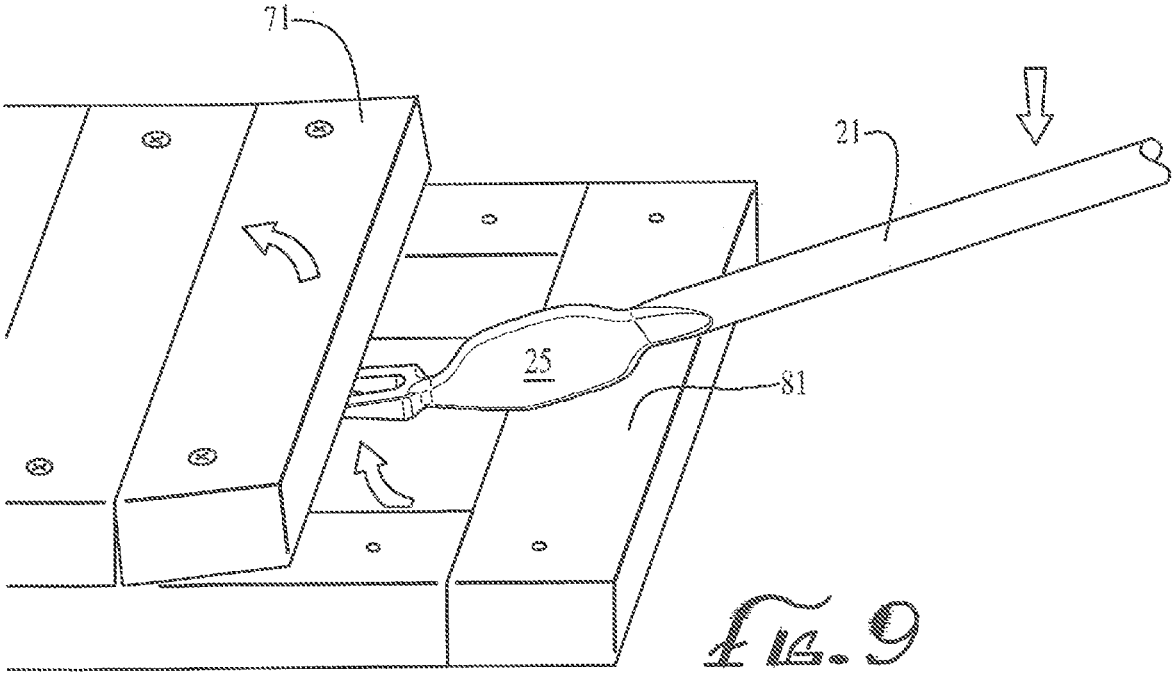
FIG. 9 is a perspective view of the distal extremity of the pry bar shown in FIG. 1 and depicting the lifting of a deck board.
Figure 10:
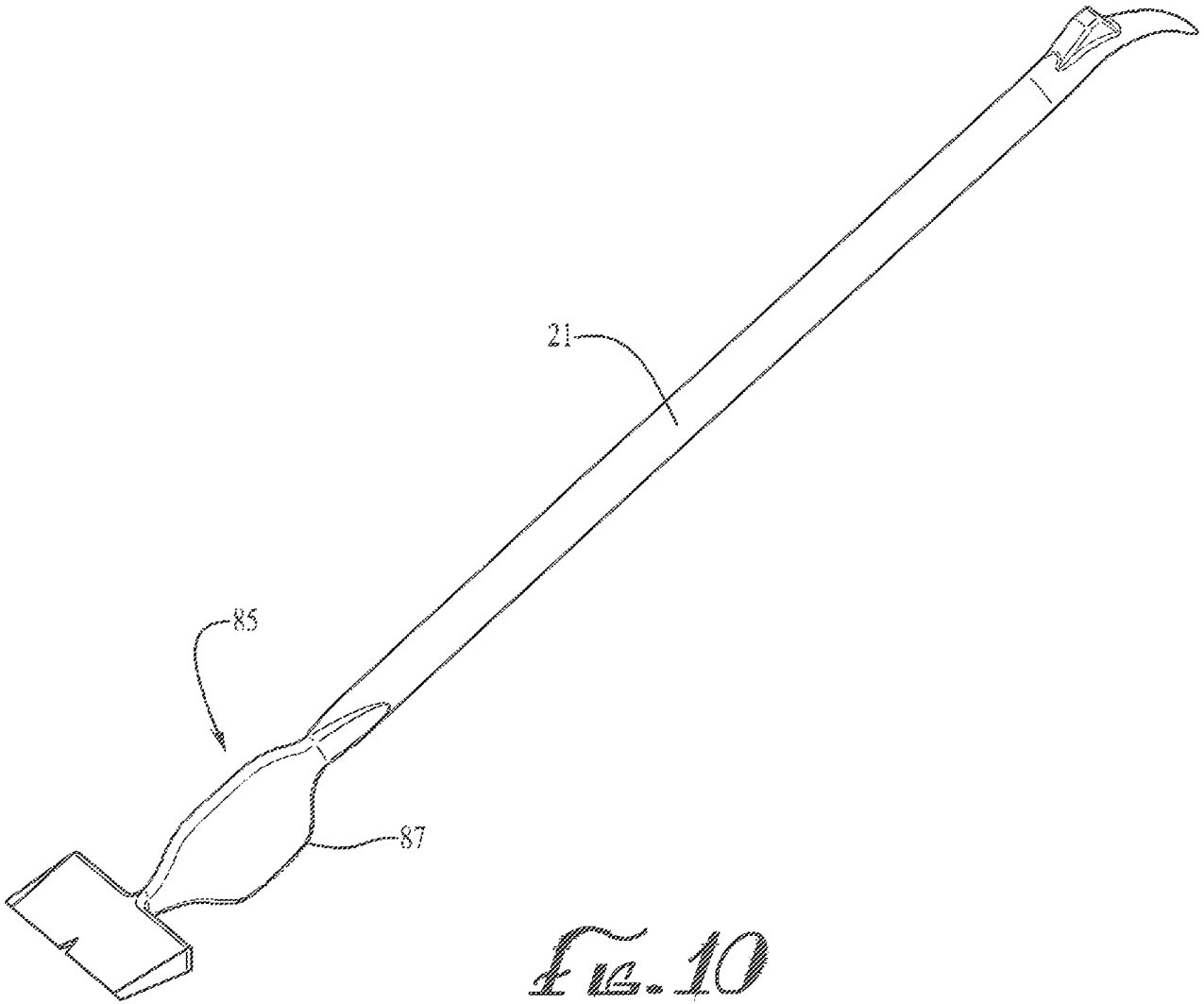
FIG. 10 is a perspective view of a second embodiment of the pry bar of the present invention.
Figure 11:
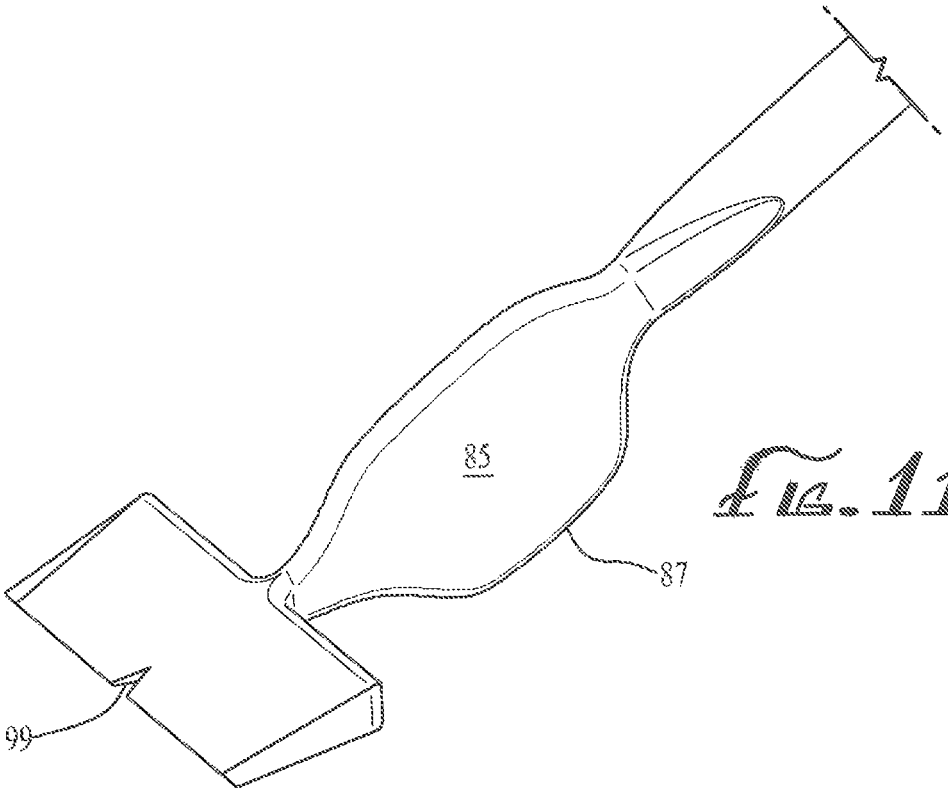
FIGS. 11, 12 and 13 are perspective, side and top views of the distal extremity of the pry bar shown in FIG. 10.

Further, by the plate being elongated and formed with the rolling fulcrum curved surface 51 being spaced rearwardly from the blade/fork, the working end of the tool has a substantial reach such that it can be readily utilized for lifting a board 71 while pried over the edge of a plank 81 (FIG. 9) to enhance the utility thereof.

Figure 12:
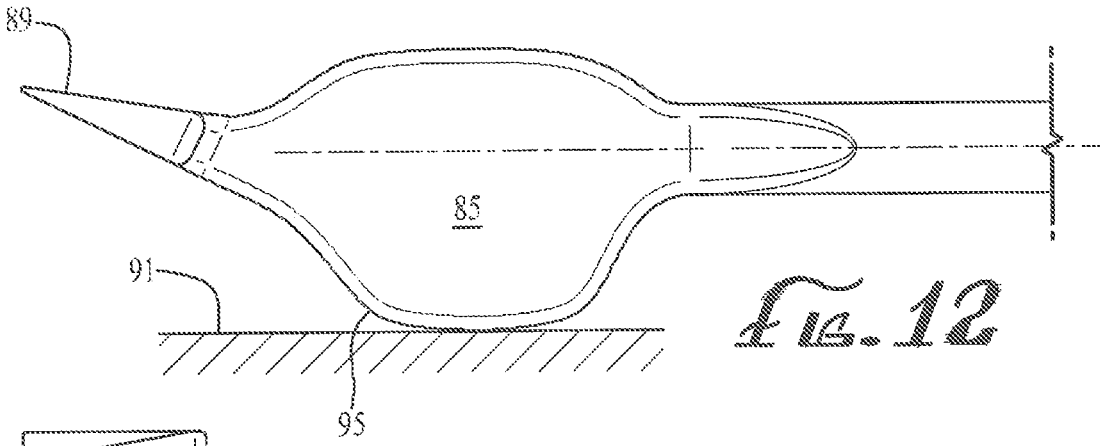
Figure 13:
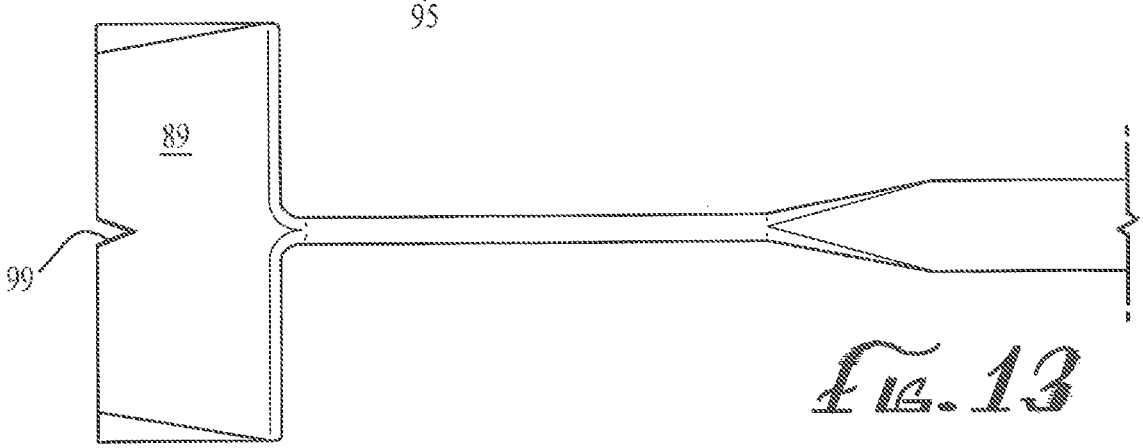

Referring to FIGS. 10 through 13, in one embodiment, the pry tool is formed with a shaft 21 configured with a fulcrum plate 85 having an asymmetrical configuration about the longitudinal access thereof such that it is formed with a downwardly projecting camlike edge 87 presenting, in transverse profile, somewhat of a guppy fish shape so that a greater lift might be afforded as shown in FIG. 12 to raise the front edge of a wedge 89 to an elevated position above the support plank 91. The cam surface 87 is formed such that the plate projects downwardly below the longitudinal axis about 1¾ inches at the apex of the edge 87 to thus provide the rolling fulcrum edge 95 spaced a substantial distance below the axis such that rotation thereabout to the position shown in FIG. 12 raises the wedge 89 about 2 inches off the support surface 91. This then provides for a greater elevation for separating deck boards further from the underlying surface and for drawing longer fasteners from that surface.

In the preferred embodiment, the wedge 89 is formed with an outside transverse dimension of about 5¾ inches but 4½ to 6 inches is acceptable. In this embodiment, I sometimes taper the opposite lateral ends of such blade distally and inwardly at a slight angle of about 5 degrees to the longitudinal axis. In the preferred embodiment, I formed the back edge of such wedge with a thickness of about ½ to ¾ inch and taper the upper and lower surfaces of the blade forwardly to a height of about 1/16 inch over a longitudinal length of about 2½ inches. This presents a wide support surface to be disposed under a deck board to raise such deck board off the support beam over an extended lateral support surface to thus minimize the tendency to break through the body of the deck board and destroy the body of such board, which may well have deteriorated over its life. I formed the forward edge of the wedge centrally with a V shaped notch 99 about 1½ inches deep and of having an open end of about 5/16 to ⅜ inch wide.

Operation of the embodiment shown in FIGS. 10 to 13, is similar to that for the embodiment of FIG. 1, except that the wedge 89 provides for a longer lateral contact under the deck board and the fulcrum plate provides for greater lift and reach in lifting the board off the underlying support surface.

Figure 3:
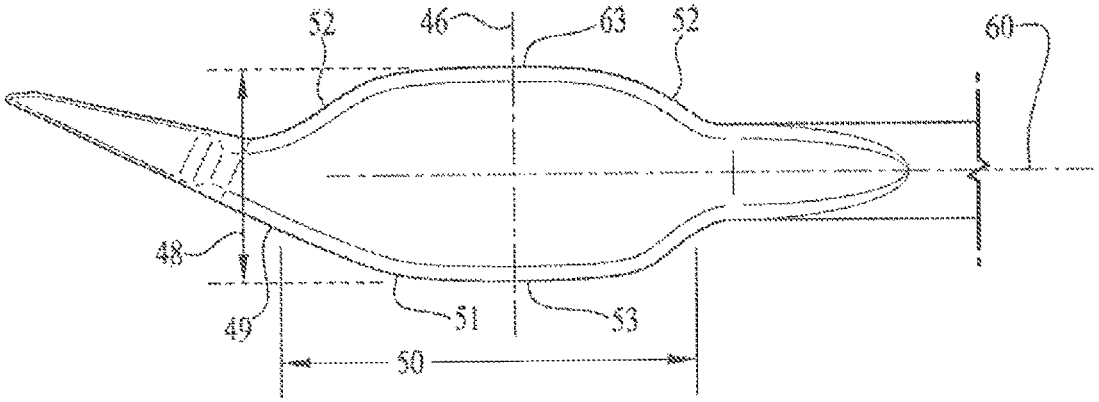
FIG. 3 is a detailed side view, in enlarged scale, of a fulcrum plate incorporated in the embodiment shown in FIG. 2.
Figure 14:
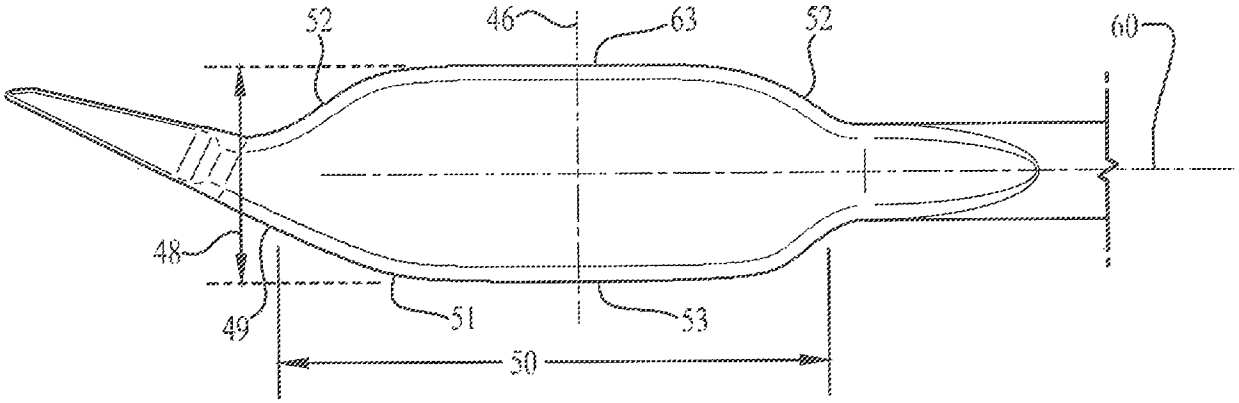
FIGS. 14 and 15 are side views of further embodiments of the pry bar of the present invention.
Figure 15:
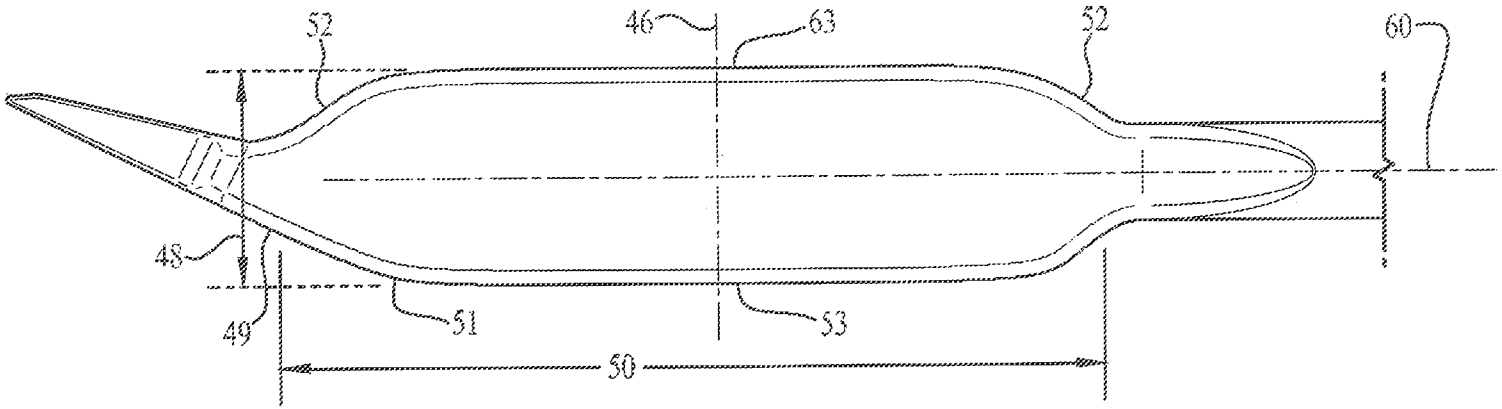

While the fulcrum plate my take many different forms and dimensions, in addition to the above, as one of my preferred embodiments, a fulcrum plate double the size of that shown in FIG. 3 so the plate is 5½ inch long as shown in FIG. 14 and in another preferred embodiment is 6 inches long (FIG. 15). It should be appreciated by those of skill that, while I specify these particular dimensions for my preferred embodiments, many other embodiments will be apparent to those of skill which may be of similar construction and various different dimensions.

From the foregoing, it will be apparent that the pry bar of the present invention derives a convenient means for removing deck boards and fasteners and the like with a robust connection between the shaft and blade for carrying high torque loads and affording convenient access to the deck boards and viewing of the operation of the working end of the pry tool.

As will be appreciated by those skilled in the art, in practice the pry bar will take many different shapes and configurations depending on the application including different lengths, widths of the puller blade, configuration and thicknesses and widths.

The invention may be embodied in other forms without departure from the spirit and essential characteristics thereof. The embodiments described therefore are to be considered in all respects as illustrative and not restrictive. Although the present invention has been described in terms of certain preferred embodiments, other embodiments that are apparent to those of ordinary skill in the art are also within the scope of the invention. Accordingly, the scope of the invention is intended to be defined only by reference to the appended claims.

I claim:

1. A pry bar comprising:

an elongated shaft at least 12 inches long to be positioned upright and rotated in a selected plane, having a predetermined lateral width and including first and second extremities;

the first extremity being in the form of a handle;

a tool formed with a wedge; and a laterally elongated fulcrum plate interposed between the second extremity and the tool having a lateral width of less than ⅜ of an inch and first and second opposite upper and lower edges, the first and second opposite upper and lower edges expanding laterally and distally beyond the predetermined cross-section of the shaft and formed on the first upper edge to curve longitudinally and laterally inwardly and form a rounded edge surface so that, when the elongated oval fulcrum plate is disposed in the selected plane, a workman may grasp the shaft and thrust the shaft and the tool forwardly to engage the wedge with a workpiece to cause the wedge to penetrate the workpiece so that as the shaft is rotated in the selected plane, the rounded edge surface will act as a fulcrum about which the bar may be pried.

2. The pry bar of claim 1 wherein:

the elongated fulcrum plate incorporates a longitudinal major axis and where the elongated fulcrum plate is at least 4 inches long along the longitudinal axis.

3. The pry bar of claim 1 wherein:

the elongated fulcrum plate is 2¾ inches wide and 5½ inches long.

4. The pry bar of claim 1 wherein:

the elongated fulcrum plate is at least 6 inches long.

5. The pry bar of claim 1 wherein:

the elongated fulcrum plate is 2½ inches wide.

6. The pry bar of claim 1 wherein:

the elongated fulcrum plate is at least 4 inches long.

7. The pry bar of claim 1 wherein:

the elongated fulcrum plate is ¼ to ⅜ inches in the lateral width.

8. The pry bar in claim 1, wherein:

the wedge is formed with a claw.

9. The pry bar in claim 1, wherein:

the shaft is 52 inches long.

10. The pry bar in claim 1, wherein:

the shaft is between 12 and 52 inches long.

* * * * *